United States Patent [19]

Sedillo

[11] Patent Number: 4,817,229

[45] Date of Patent: Apr. 4, 1989

[54] QUICK CHANGE WIPE DOWN KNIFE WITH ROTATABLE BLADE

[75] Inventor: Michael J. Sedillo, Carmichael, Calif.

[73] Assignee: Winchar Enterprises, Petaluma, Calif.

[21] Appl. No.: 192,215

[22] Filed: May 10, 1988

[51] Int. Cl.[4] ..... B05C 17/10

[52] U.S. Cl. ..... 15/104 S; 15/144 R; 15/236.01

[58] Field of Search ..... 15/104 S, 245, 236.01, 15/236.05, 144 R

[56] References Cited

U.S. PATENT DOCUMENTS

| | | | |
|---|---|---|---|
| 304,909 | 9/1884 | Coleman | 15/144 R |
| 363,561 | 5/1887 | Stoddard | 15/236.05 X |
| 403,522 | 5/1889 | DuBuisson | 15/236.05 X |
| 891,871 | 6/1908 | Smith | 15/236.01 X |
| 1,704,376 | 3/1929 | Teasdale | 15/236.01 X |
| 3,078,491 | 2/1963 | Ames | 15/104 S |
| 3,206,788 | 9/1965 | Hahn | 15/144 R X |
| 3,250,000 | 5/1966 | Schumann | 15/236.05 X |
| 3,261,095 | 7/1966 | Nelson et al. | 15/144 R X |

*Primary Examiner*—Chris K. Moore

*Attorney, Agent, or Firm*—Majestic, Parsons, Siebert & Hsue

[57] ABSTRACT

A wipe down knife of the type used in drywall construction that has a knife blade attached to a handle in a manner that the blade is rotatable by hand between two stable rotatable positions. The blade is maintained in either of those positions by a combination of a positive stop to prevent the blade from rotating in one direction and a frictional pivot to make it difficult to rotate in the other direction.

9 Claims, 2 Drawing Sheets

QUICK CHANGE WIPE DOWN KNIFE WITH ROTATABLE BLADE

BACKGROUND OF THE INVENTION

This invention is related generally to a construction hand tool, and more particularly to a wipe down knife used in drywall plaster construction.

Typically, interior residential and commercial building walls are formed by attaching sheets of plaster board to supporting studs. Spaces between the sheets are taped and covered with a thin layer of joint compound commonly called "mud". A wipe down knife tool is then used by the builder to smooth out the joint compound and tape layer so that the seam does not show. Indentations around nails and other imperfections are similarly treated.

Most walls are high with respect to the craftsman using such a tool. This requires the craftsman to use a tool to smooth joint compound and tape at elevations extending from a floor to a ceiling. Existing wipe down knives have a seven inch blade, for contacting and smoothing the joint compound and tape, that is rigidly attached to a handle. It is difficult to maintain the blade at a proper orientation with respect to the wall at all such working heights.

Therefore, it is a primary object of the present invention to provide a wipe down knife tool having a blade that is adjustable in position with respect to the handle, thereby making it easier to use at various elevations with respect to the craftsman who is using it, and in small places where access is difficult.

SUMMARY OF THE INVENTION

This and additional objects are accomplished by the various aspects of the present invention wherein, briefly, the wipe down knife tool blade is attached to its handle in a manner to provide two stable rotatable positions of the blade with respect to the handle, the blade being adjustable by hand without the user having to manipulate any positive latch or detent. The two stable positions are provided less than 90 degrees from each other, preferably somewhere in the range of from 50 to 80 degrees. This allows sufficient adjustment of the blade with respect to the handle for the user to easily access the entire height of a wall and to access small, hard-to-get locations such as corners, in closets, eight foot bands, and the like.

In a preferred form, one extreme rotatable position, wherein the blade extends directly away from the end of the handle, is provided by an abutment on the blade that engages a side of the handle. The second extreme rotatable position, wherein the blade is positioned to the side of the handle, is defined by an end of a slot in the handle in which the blade is captured, an edge of the support blade engaging the bottom of this slot. The rotatable attachment of the blade and handle is accomplished with a frictional engagement such that the blade will not rotate with respect to the handle while the tool is being used, but not so strong that easy rotation of the blade by hand is prevented.

Additional objects, advantages and features of the present invention will become apparent from the following description of a preferred embodiment, which description should be read in conjunction with the accompanying drawings.

DESCRIPTION OF A PREFERRED EMBODIMENT

Figures 1, 2, 3:
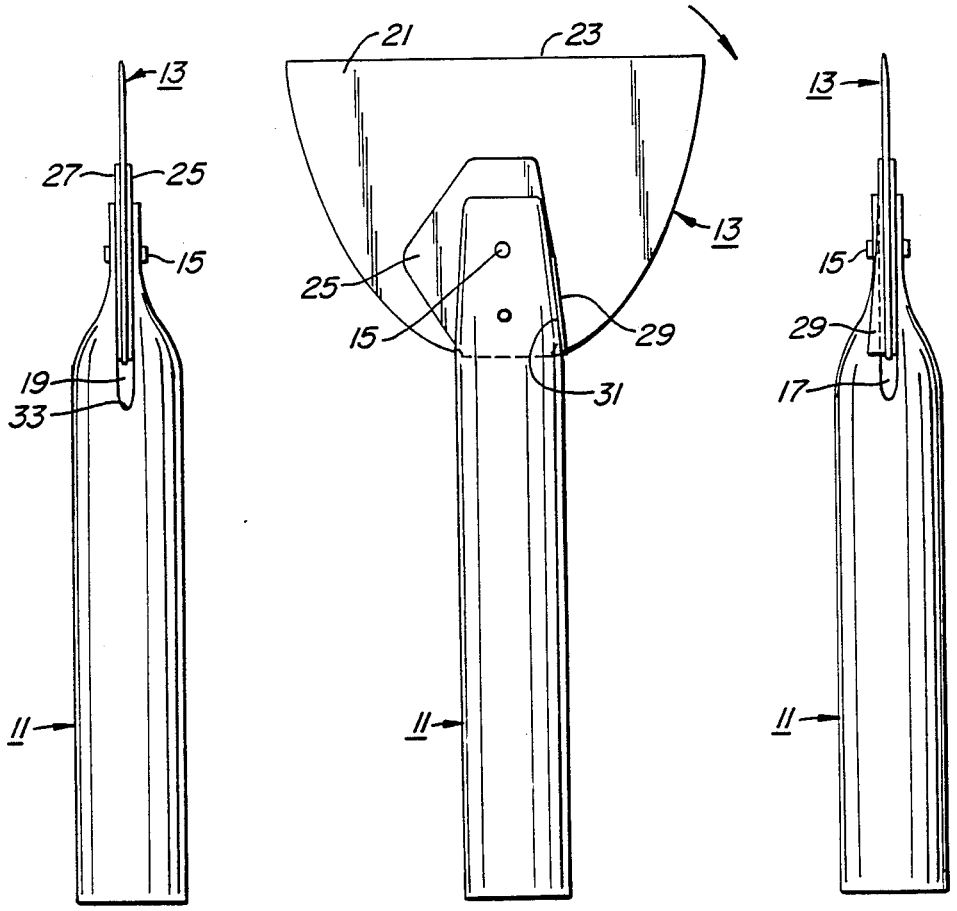
FIG. 1 shows in plan view a wipe down knife that includes the improvement of the present invention.
FIG. 2 is a view of the wipe down knife of FIG. 1 from the left side thereof.
FIG. 3 is a view of the wipe down knife of FIG. 1 from the right side thereof.

The wipe down knife illustrated in the accompanying figures has two main components. The first component is a handle 11, and a second component is a blade structure 13. In this example, the handle 11 is constructed of tubular stock material, preferably aluminum. At one end thereof, the blade structure 13 is attached to the handle 11 by a fastener 15, such as a screw, rivet or the like, but in a manner that allows the blade structure 13 to be rotated by hand with respect to the handle 11 around the fastener 15 as a pivot. The blade structure 13 is captured by that end of the handle 11 in a pair of slots 17 and 19 on opposite walls of the tubular material. Enough of the handle 11 is cut away in the region of the slots 17 and 19 so that end of the handle 11 is flattened at the point where it is attached to the blade structure 13 by the fastener 15.

The blade structure 13 primarily consists of a blade 21 made of a metal material and with a thickness so that it is slightly flexible. The usual material for the blade 21 is stainless steel. The blades of such tools come in various widths for a variety of specific applications but are most commonly provided with a long, straight edge 23 that is from 3 to 8 inches in width. It is this edge that contacts the joint compound or mud. In use, it is positioned with the entire blade edge firmly held against the wall being built.

In order to strengthen the blade structure 13 in the region of the pivotal attachment with the handle 11, additional thin layers of material 25 and 27 are provided on opposite sides of the blade 21, being attached together by spot welding or some other appropriate technique.

The rotatable extent of the blade structure 13 with respect to the handle 11 is defined by two sets of mechanical stops. The first stop, which defines the rotatable position shown in FIG. 1, includes an upturned lip portion 29 of the strengthening piece 25. The lip 29 is formed into a shape so that it abuts a surface portion 31 of the handle 11 when the blade 13 is in a desired first stable rotatable position. This limits the rotation of the blade 13 with respect to the handle 11 in a clockwise position, in the view of FIG. 1.

Figure 4:
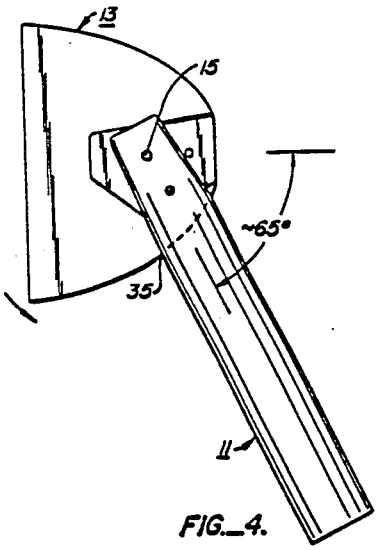
FIG. 4 shows the wipe down knife of FIGS. 1–3 with its blade rotated with respect to its handle.

FIG. 4 illustrates the tool with its blade 13 rotated as far in a counter-clockwise direction with respect to the handle 11 as it is permitted to go. Such a position is the second stable rotatable position of the blade. This rotatable limit is provided by properly positioning an end 33 of the groove 19 in the handle 11 so that a point 35 on an edge of the blade piece 21 abuts against it when the blade is rotated to its maximum position in a counter-clockwise direction, when viewed from the direction of the figures. The depth of the groove 19 in the handle 11 controls this second rotatable position and is selected to allow rotation of around 65 degrees, in this example. Other specific rotational extents may alternatively be used, but is preferred to be less than 90 degrees, primarily in a range from 50 to 80 degrees.

These two rotatable positions are rendered stable by the structure being described without the need of any positive detent or latch between the blade and handle. This is accomplished by providing a frictional coupling between the blade structure 13 and the handle 11 through the pivotal fastener 15. The amount of friction is controlled by the amount of force that is applied by the fastener 15 to urge the opposing handle portions against the blade structure 13. The amount of friction can also be controlled by providing an appropriate rubber or plastic washer around the fastener 15 on each side of the blade assembly 13 and in contact therewith. Each of the washers is then captured and held in compression between the blade structure 13 and interior surface of the handle 11 that is being held by the fastener 15. The amount of friction, thus controllable during manufacture of the tool, is selected to allow hand rotation by the craftsman between the two stable positions, but having enough friction so that rotation is avoided when the tool is being used.

Figure 5:
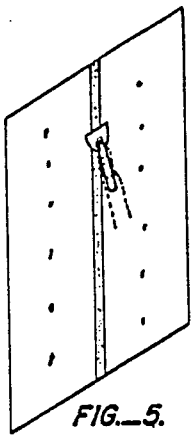
FIG. 5 shows an example of the wipe down knife of FIGS. 1–4 being used without the blade being rotated.

FIG. 5 illustrates use of the tool shown in FIGS. 1–4 to spread tape and joint compound (mud) over a vertical taped seam between sheets of plaster board. The craftsman finds it most convenient for that application to maintain the blade 13 in its rotatable position shown in FIG. 1. That is the position in which blades of currently used tools are permanently attached to their handles.

Figure 6:
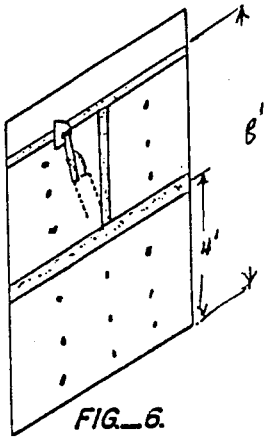
FIG. 6 shows an example of the use of the wipe down knife according to FIGS. 1–4 with its blade rotated.

FIG. 6 illustrates an application where the craftsman may find it desirable to rotate the blade with respect to the handle into its second stable position illustrated in FIG. 4. The example of FIG. 6 is a horizontal taped seam between sheets of plaster board that is considerably over the head of the craftsman. Such a seam eight feet above the floor is typical. Use of the tool with the blade in the position shown in FIG. 1 for such an operation is difficult. But by enabling the rotation of the blade in the tool being described, the handle can be directed downward to effectively extend the reach of the craftsman. The particular angle of rotation of the handle and blade that is allowed which was discussed previously is chosen to be most comfortable and usable to the craftsman. It will also be noted that, with the angles shown in FIGS. 4 and 6, normal use of the tool will cause the blade point 35 to be urged against the bottom 33 of the groove 19, thus aiding in maintaining the blade in that rotatable position during use.

It can also be observed from FIGS. 1 and 5 that the common use of the tool there illustrated does not result in any forces being imparted to the blade 13 that would tend to rotate it out of the stable position there illustrated. Therefore, frictional engagement between the blade and handle at the point of the fastener 15 is sufficient to prevent undesired rotation of the blade out of a desired rotatable position. At the same time, the frictional engagement need not be made so tight to make it difficult to rotate by hand between the two extreme positions. However, a ball type of detent can be added to the blade piece 25, as shown by the circle in FIG. 4, with a mating socket in the handle 11 to more positively hold the blade in the position shown in FIGS. 1 and 5.

Although the present invention has been described with respect to a particular example of its implementation, it will be understood that the invention is entitled to protection within the full scope of the appended claims.

It is claimed:

1. In a wipe down knife hand tool having a tubular shaped handle and a flat knife blade attached adjacent one end thereof in a slot of said tube, the improvement comprising:

said blade being pivotally and frictionally engaged to said handle in a manner allowing rotation therebetween by application of force by hand but not allowing rotation by the weight of the blade itself, a first stop attached to said blade in a position to engage a side of said handle when rotated in one direction about said pivotable attachment, and a second stop provided as an end of said handle slot that engages an edge of the blade as the blade is rotated to its second stable position, whereby two stable rotatable positions of the blade with respect to the handle are provided without any mechanical latch or detent that additionally needs to be manipulated.

2. The wipe down knife tool according to claim 1 wherein said first and second stops are positioned in a manner that said blade is rotatable with respect to said handle through a maximum angle within a range of substantially 50 degrees to 80 degrees.

3. The wipe down knife tool according to claim 2 wherein said maximum angle is substantially 65 degrees.

4. The wipe down knife tool according to claim 1 wherein said blade includes a straight edge, and wherein the blade is engaged to said handle with said straight blade edge oriented substantially orthogonally with respect to a long direction of said handle when rotated so that said first stop engages the handle.

5. The wipe down knife tool according to claim 1 wherein said blade is pivotally engaged to said handle at a single pivot point, a plate is attached to said blade at and around said pivot point, and said first stop includes an upturned portion of an edge of said plate.

6. The wipe down knife tool according to claim 1 which additionally comprises mating detent and socket provided in said handle and said blade in positions to be engaged when the blade is rotated to a position wherein its said first stop engages said handle edge.

7. In a wipe down knife hand tool having a handle and a flat knife blade attached adjacent one end thereof with a straight edge of the blade oriented substantially orthogonally with a length of said handle, the improvement comprising:

said blade being frictionally held by said handle at a pivot point in a manner allowing rotation therebetween around said pivot by application of force by hand but not allowing rotation by the weight of the blade itself, first cooperative means provided on said blade and said handle for defining a first stable rotational position of said blade with respect to said handle wherein said blade straight edge is substantially orthogonal to the length of the handle, whereby the blade is oriented as in the unimproved tool, and second cooperative means provided on said blade and said handle for defining a second stable rotational position of said blade with respect to said handle, said first and second stable rotational positions being separated by an angle that is substantially within a range of from 50 degrees to 80 degrees, whereby the blade straight edge is oriented differentially with respect to the handle than when in the first stable rotational position, each of said first and second position defining means operating solely in response to rotation of the blade.

8. In a wipe down knife hand tool having a handle and a flat knife blade attached adjacent one end thereof with a straight edge of the blade oriented substantially orthogonally with a length of said handle, the improvement comprising:

said blade being frictionally held by said handle at a pivot point in a manner allowing rotation therebetween around said pivot by application of force by hand but not allowing rotation by the weight of the blade itself, first cooperative means provided on said blade and said handle for limiting rotation of the blade with respect to the handle in one direction to a first extreme position wherein said blade straight edge is substantially orthogonal to the length of the handle, whereby the blade is oriented as in the unimproved tool, and second cooperative means provided on said blade and said handle for limiting rotation of the blade with respect to the handle in an opposite direction to a second extreme position, said first and second extreme positions being separated by an angle less than 90 degrees, whereby the blade straight edge is oriented differentially with respect to the handle than when oriented as in the unimproved tool, wherein said first and second extreme positions are provided without any mechanical element that needs to be manipulated by hand other than rotation of the blade with respect to the handle.

9. The wipe down knife tool according to claim 8 wherein said first and second extreme positions are separated by an angle substantially within the range of from 5 to 50 degrees.

* * * * *

UNITED STATES PATENT AND TRADEMARK OFFICE

CERTIFICATE OF CORRECTION

PATENT NO. : 4,817,229

DATED : April 4, 1989

INVENTOR(S) : Sedillo

It is certified that error appears in the above-identified patent and that said Letters Patent is hereby corrected as shown below:

Col. 6, line 20: replace "5 to 50" with --50 to 80--.

Signed and Sealed this

Thirty-first Day of October, 1989

*Attest:*

DONALD J. QUIGG

*Attesting Officer*

*Commissioner of Patents and Trademarks*